US010882076B2

(12) United States Patent
Wirokarso et al.

(10) Patent No.: US 10,882,076 B2
(45) Date of Patent: Jan. 5, 2021

(54) METHOD FOR SORTING TIRES

(71) Applicant: Black Bear Carbon B.V., Nederweert (NL)

(72) Inventors: Dion Wirokarso, Nederweert (NL); Marvin Geraerts, Nederweert (NL)

(73) Assignee: BLACK BEAR CARBON B.V., Netherlands (NL)

( * ) Notice: Subject to any disclaimer, the term of this patent is extended or adjusted under 35 U.S.C. 154(b) by 243 days.

(21) Appl. No.: 16/071,362

(22) PCT Filed: Jan. 17, 2017

(86) PCT No.: PCT/NL2017/050024

§ 371 (c)(1),
(2) Date: Jul. 19, 2018

(87) PCT Pub. No.: WO2017/126958

PCT Pub. Date: Jul. 27, 2017

(65) Prior Publication Data

US 2020/0215578 A1 Jul. 9, 2020

(30) Foreign Application Priority Data

Jan. 20, 2016 (NL) ..... 2016124

(51) Int. Cl.
*C10B 53/07* (2006.01)
*B07C 5/34* (2006.01)

(52) U.S. Cl.
CPC ..... *B07C 5/3416* (2013.01); *C10B 53/07* (2013.01)

(58) Field of Classification Search
CPC ..... C10B 53/07; B07C 5/3416
See application file for complete search history.

(56) References Cited

U.S. PATENT DOCUMENTS

| | | | | |
|---|---|---|---|---|
| 5,230,777 | A * | 7/1993 | Jarrell | C07C 1/00 202/105 |
| 5,518,055 | A * | 5/1996 | Teeple | B60C 11/18 152/152.1 |
| 6,525,105 | B1 | 2/2003 | Udagawa et al. | |
| 8,247,527 | B2 * | 8/2012 | Fader | B02C 19/0012 528/481 |
| 9,580,606 | B2 * | 2/2017 | Verberne | C09C 1/482 |
| 10,119,031 | B2 * | 11/2018 | Verberne | C09C 1/482 |
| 2004/0067649 | A1 * | 4/2004 | Hellring | C09K 3/1463 438/689 |
| 2010/0210782 | A1 * | 8/2010 | Fader | B02C 19/061 524/496 |

(Continued)

FOREIGN PATENT DOCUMENTS

| | | |
|---|---|---|
| DE | 4003980 | 8/1990 |
| DE | 4405540 | 8/1995 |

(Continued)

*Primary Examiner* — Jonathan Miller
(74) *Attorney, Agent, or Firm* — Casimir Jones, S.C.; Tanya Arenson

(57) ABSTRACT

The present invention relates to a method for sorting tires (15) on basis of its components as well as to an apparatus for carrying out such a method. The present invention also relates to the use of scrap rubber in a pyrolysis process to obtain a char material. The method for sorting tires (15) on basis of silica content (7).

20 Claims, 1 Drawing Sheet

(56) References Cited

U.S. PATENT DOCUMENTS

| | | | | |
|---|---|---|---|---|
| 2014/0371385 | A1* | 12/2014 | Verberne | C08K 3/36<br>524/571 |
| 2014/0378593 | A1* | 12/2014 | Kagawa | C08L 65/02<br>524/322 |
| 2017/0114222 | A1* | 4/2017 | Verberne | C08K 3/04 |

FOREIGN PATENT DOCUMENTS

| | | |
|---|---|---|
| EP | 0652430 | 5/1995 |
| JP | H07-333145 | 12/1995 |
| WO | 2011/159269 | 12/2011 |
| WO | 2014/005438 | 1/2014 |

* cited by examiner

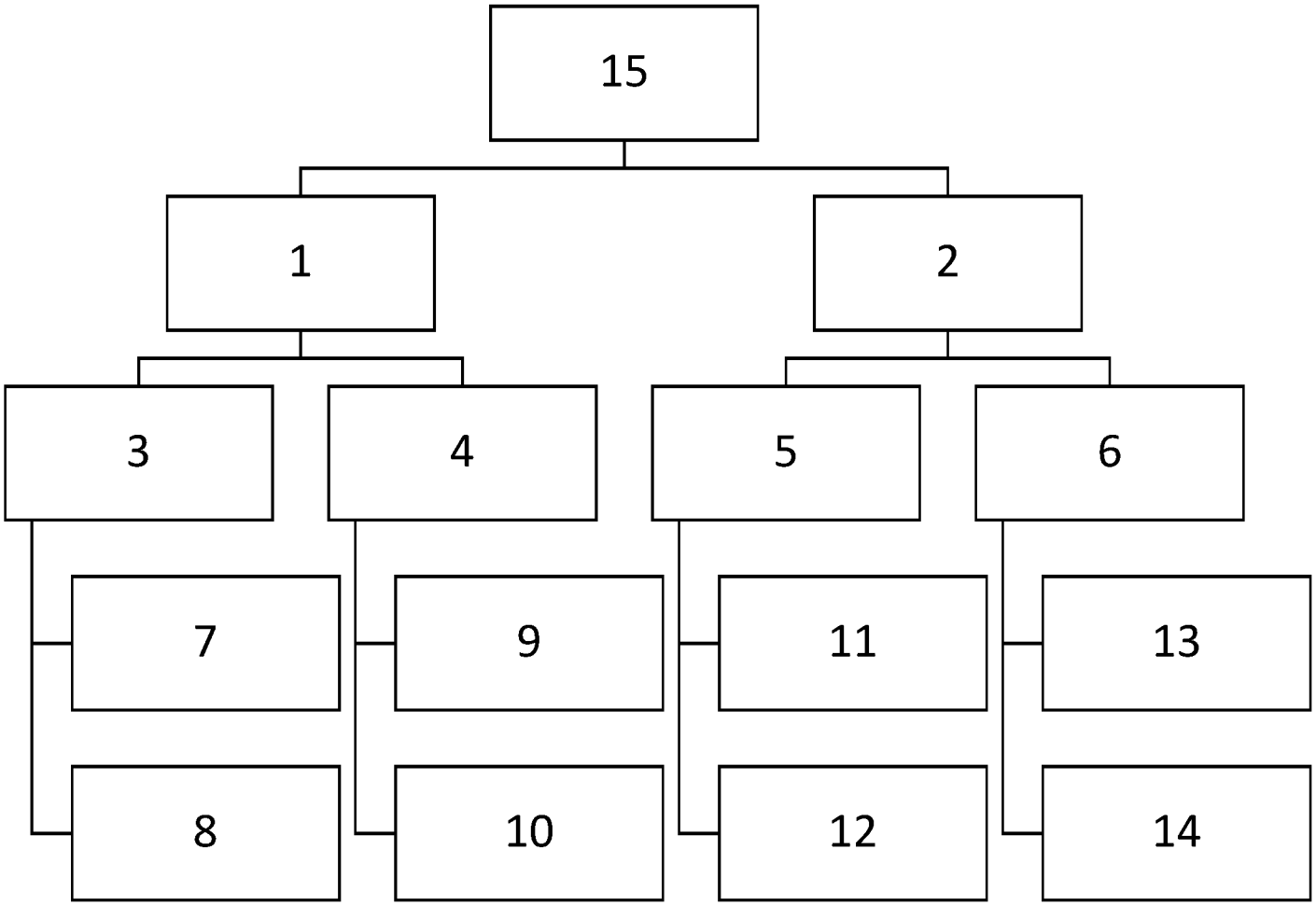
15
2
1
6
5
4
3
13
11
9
7
14
12
10
8

METHOD FOR SORTING TIRES

The present invention relates to a method for sorting tires on basis of its components as well as to an apparatus for carrying out such a method. The present invention also relates to the use of scrap rubber in a pyrolysis process to obtain a char material.

Passenger car, lorry and off-the-road ("OTR") tires are products of complex engineering. They are made up of numerous different rubber compounds, many different types of carbon black, fillers like clay and silica, and chemicals & minerals added to allow or accelerate vulcanization. The tires also have several types of fabric for reinforcement and several kinds and sizes of steel. Some of the steel is twisted or braided into strong cables.

In compound formulations, natural rubber reduces internal heat generation in tires, whilst offering high mechanical resistance. It is used in many parts of the tire, mainly used for truck and earthmover tire tread. Synthetic elastomers deform under stress and return to their original shape when the stress is removed (hysteresis). This property is extremely valuable for the manufacture of high-grip tires. Synthetic rubber also provides other specific properties, most notably in the areas of longevity and rolling resistance. It's mainly used for passenger car and motorcycle tire as it gives them good grip performances Carbon black added to the rubber compound produces a tenfold increase in wear resistance of the tires. It represents 25 to 30% of the rubber composition and gives tires their distinctive color. Indeed, this color is very effective in acting against ultraviolet rays to prevent the rubber from fissuring and cracking. Silica, obtained from sand, has properties that have long been recognized, including the improved resistance of rubber compounds to tearing, especially a low rolling resistance, good grip on a cold surface and exceptional longevity. Amorphous silica, silica gel, is produced by the acidification of solutions of sodium silicate. The gelatinous precipitate is first washed and then dehydrated to produce colorless microporous silica. Sulphur is a vulcanizing agent that transforms the rubber from a plastic to an elastic state. Its action is accompanied by retarding and accelerating products used simultaneously during production which optimize the action of heat when the tire is cured. Since then, steel has been adopted in the reinforcement of belts for radial tires. Metal reinforcements give the tire resistance and rigidity. Fabric reinforcement currently plays an important role in high-performance, high-speed tires. Polyester, nylon, rayon and aramid are all used to manufacture the reinforcements, which provide added resistance, endurance and comfort. Every tire has its own identity card on the sidewalls that is useful if you know how to decrypt it. These markings provide information on the technical characteristics of tires and their performance.

Tire recycling or rubber recycling is the process of recycling tires (generally vehicles' tires) that are no longer suitable for use on vehicles due to wear or irreparable damage (such as punctures). These tires are also known as 'End-of-Life' (ELT) tires. These tires are among the largest and most problematic sources of waste, due to the large volume produced and their durability. Recycling tires is, however, a difficult and costly process and as a result millions of tires every year are worn out and accumulated, often in landfill sites. Scrap tires are bulky and they take up a significant amount of space, even if compacted. Furthermore such used tires also cause air pollution if burned.

One known way to recycle tires is by means of pyrolysis. Pyrolysis uses heat in the absence of oxygen to decompose the tire to yield steel, volatile gases and carbonaceous char.

U.S. Pat. No. 5,037,628 discloses a pyrolysis method for reclaiming carbonaceous materials from scrap tires by pyrolyzing the scrap tires in a one-step pyrolysis process to form a char material.

US2002119089 describes a one stage process for pyrolyzing scrap tires involving the use of a rotating auger. The carbon black product has an average particle size of 0.125 mm making the product only suitable for low grade applications.

US 2008286192 describes a batch process for the two-stage pyrolysis of tires. The char material is not milled but used directly in rubber formulations.

In addition, WO 2013/095145 in the name of the present inventors discloses a process of pyrolyzing scrap tires to produce a char material that can be milled to produce a carbon black powder that can be used as a filler or reinforcing agent in a rubber composition, an ink, a paint, a bitumen, a thermoplastic composition or a thermoplastic elastomer. Typical components of a char material are carbon black, residue material, silica, volatiles and water. Given the variety of scrap tires, the method according to WO 2013/095145 is suitable for pyrolyzing scrap rubber with varying amounts of silica. WO 2013/095145 discloses that the feedstock tires used to prepare the scrap rubber used as a starting material have a silica content of less than 15%, more preferably less than 10% and even more preferably less than 5%. However, WO 2013/095145 is totally silent about any method for sorting tires on its silica contents.

U.S. Pat. No. 4,836,386 relates to an apparatus for sorting substantially horizontally disposed tires having vertically spaced upper and lower annular beads from a conveying means having tires of various types disposed on the conveying means comprising: (a) identifying means adapted to determine the types of tires on the conveying means; and (b) generally horizontally moveable transport means responsive to the identifying means for removing a tire in a generally horizontally sliding movement from the conveying means wherein the transport means includes a pivotally mounted arm member which engages an area of the upper bead of the tire and causes a slight lifting of one side only of the tire beneath the engaged upper bead area to enable lateral sliding movement of the tire from the conveying means with a reduction of frictional resistance due to the lifting of the one side without completely lifting the tire from the conveying means when displaced by the transport means.

U.S. Pat. No. 4,778,060 relates to a sorting apparatus which sorts tires according to an alphanumeric code assigned to a tire manufacturer carried by them, which code is printed at predetermined intervals, directly on the tread of each tire. The code is optically read by a line-scan camera. The information is processed by a microprocessor which controls the discharge of tires on a conveyor belt from which they are ejected according to the sets into which the tires have been sorted. A system using the apparatus is adapted to a situation where an article is to be identified by an alphanumeric code, transferred to a processing station where it is processed, then transferred to an output station from which it is discharged to a main conveyor which supplies sorting conveyors.

European patent application EP 2 532 610 relates to a tire sorting apparatus for sorting tires by reading information from tire identification markings (tire identifiers), such as barcodes, formed on the surface of tires.

WO 2011/159269 relates to a method of classifying material, wherein a number of potential classifications are available, the method comprising acts of detecting x-rays fluoresced from the material, detecting optical emissions emitted from a plasma resulting from a vaporization of a portion of the material; and classifying the material based on the detected x-rays and the detected optical emissions, including acts of reducing the number of potential classifications by analyzing only a first one of two types of emissions: the detected x-rays or the detected optical emissions; and selecting one of the reduced number of classifications by analyzing only a second one of the two types of emissions that was not analyzed including analyzing only the detected optical emissions and analyzing only the detected x-rays.

European patent application EP 0 652 430 relates to a process for determining the carbon black concentration and distribution in rubber compounds and other carbon black-containing materials using pulsed laser beams focused on the material surface each of which produce a plasma with a radiation characteristic of the elements or molecules contained therein and divide the surface with their end regions into grid areas in which are located measuring points formed by the laser beam focuses, whereby the characteristic radiation, spectrally dispersed in the form of spectral lines or molecule bands, is measured by a detector unit and whereby from the concentration values calculated by reference to numerical ratios from the radiation intensities of selected elements/molecules with subsequent storage and allocated to the relevant measuring points, the concentration value curve at least over a section of the surface is established.

JPH07333145 relates to a sulfur inclusion concentration measuring device for a rubber sheet, allowing the concentration of sulfur contained in a rubber sheet to be measured without interrupting a manufacturing process.

WO2015/162443 relates to an apparatuses for cutting the sidewalls of tires, in which the tire is held by jaws sliding on a rotary plate, and the sidewalls are separated from the tread by transverse, opposing blades.

WO2005/077538 relates to a tire recycling apparatus for shredding and recycling tires and in particular vehicle rubber tires that are reinforced with metal wire.

An object of the present invention is to provide a method for sorting tires which is highly accurate and can be carried without a step of first destructing the tire before a step of sorting.

Another object of the present invention is to provide a method for controlling the quality of carbon black in a process of pyrolyzing scrap tires to produce a char material comprising carbon black.

Another object of the present invention is to provide a method for sorting tires which method can be carried on a continuous basis.

Another object of the present invention is to provide a method for sorting tires which method can be carried out on tires originating from any vehicle, such as passenger cars, trucks, motor cycles and agricultural vehicles.

Another object of the present invention is to provide a method for sorting tires which method does not make use of a complex database containing tire identification markings.

An aspect of the present invention is to separate waste tires into at least two streams because of the influence of the composition of these waste tires on the quality of carbon black produced in a pyrolysis process.

The present method for sorting tires on basis of its components is characterized in that the tires are sorted on basis of its silica content.

By using this sorting technology the inventors will be able to control the silica content in the carbon black output in a process of pyrolyzing scrap tires to produce a char material comprising carbon black.

In a preferred method for sorting tires the silica content of the tires is measured by using one or more sensor-based technologies chosen from the group of electrical resistivity (ER), X-ray fluorescence (XRF), Near-infrared (NIR) and laser-induced plasma spectroscopy (LIPS). By using this sorting technology the inventors will be able to control the silica content in the carbon black output to ±1 wt. % between a range of −5% to 25%. Electrical resistivity (ER) refers to a measurement wherein an electrical insulation tester is used to measure the surface resistivity of a tire. Since silica can be identified as an insulator, the higher the silica content of a tire, the higher its surface resistivity. Near-infrared (NIR) spectroscopy (NIRS) is a spectroscopic method that uses the near-infrared region of the electromagnetic spectrum (from about 700 nm to 2500 nm) wherein the spectra are used to assign specific features to specific chemical components. Laser-induced plasma spectroscopy (LIPS) or Laser-induced breakdown spectroscopy (LIBS) is a type of atomic emission spectroscopy which uses a highly energetic laser pulse as the excitation source wherein the laser is focused to form a plasma, which atomizes and excites samples. In another embodiment of the present method for sorting tires the silica content of the tires is measured by using a combination of sensor-based technologies chosen from the group of electrical resistivity (ER), X-ray fluorescence (XRF), Near-infrared (NIR) and laser-induced plasma spectroscopy (LIPS).

A preferred method for sorting tires is based on X-ray fluorescence (XRF). Such X-ray fluorescence (XRF) is the emission of characteristic "secondary" (or fluorescent) X-rays from a material that has been excited by impact with high-energy X-rays or gamma rays. Radiation that is preferably used in the present XRF technology is X-radiation. The photons of X-ray have a lower energy than gamma radiation. An example of such a measurement apparatus is an on-line XRF analyzer, namely CON-X03M model, produced by Baltic Scientific Instruments. Such an apparatus uses a close geometry of measuring unit and partial evacuation of the air from the measuring space. The approach of the measuring device to the surface of the material being analyzed is an important aspect of the XRF measurement of the light elements: the XRF photons, which they emit, have very low energies and easily absorbed in the air gap between the sample surface and analyzer. The present inventors found that a smaller distance to the silicon-containing material and evacuation of the air from the measuring cell provides an opportunity to detect silicon XRF line arising from the material with higher accuracy and lower detection limit resulting in higher quality and reliability of the results.

In the method according to the present invention it is not necessary to pretreat the tires to be sorted. This means that non-destructed tires are used as a starting material. However, in practice materials identified as non-tires, such as plastic, paper, sand and stones, are preferably removed before starting the pre-sorting method. In order to prevent unwanted interference signals or low intensity signals it is preferred that the surface of the tires on which the measurement is to be carried out is dry. The term "dry" means the absence of a layer of moisture or the presence of water droplets. Please note that "dry" does not mean 0% of moisture, since the air surrounding the tires is sometimes humid resulting from a natural environment.

The present inventors found that it is preferred to carry out the measurement on the tire tread surface of the tires. The present inventors found that most of the silica used in a tire is present in the tire tread surface, and not in the side wall. Therefore, the measurement of the silica content is preferably carried out on that part of the tire where the silica content is predominant. A modern day radial passenger car tire is made up of several rubber compounds of which the tread is the single largest percentage, i.e. around 33 wt. %.

In order to be able to control the silica content in the carbon black output in a process of pyrolyzing scrap tires it is preferred that tires are sorted in a low silica content stream and a high silica content stream. It is preferred that the low silica content stream consists of tires in which 90% of the tires has a silica percentage lower than 15 wt. % and that the high silica content stream consists of tires in which 90% of the tires has a silica percentage higher than 15 wt. %, wherein the weight percentage is based on the total weight of the tire.

According to another preferred embodiment it is preferred that the tires are sorted in a low silica content stream and a high silica content stream, wherein the low silica content stream consists of tires in which 95% of the tires has a silica percentage lower than 15 wt. % and wherein the high silica content stream consists of tires in which 95% of the tires has a silica percentage higher than 15 wt. %, wherein the weight percentage is based on the total weight of the tire.

In another embodiment the tires are sorted into several streams, i.e. streams each having a different range of silica content. Please note that some streams may have an overlapping range of silica content. Thus, the present invention is not explicitly restricted to only two streams, i.e. a low silica content stream and a high silica content stream, but a higher number of streams can be obtained as well.

In another embodiment it is also possible that a stream already sorted is subjected to an additional step of sorting. For example, the first step of sorting provides a raw partition of the tires and after that initial sorting step one of the previously obtained streams is further subjected to a sorting method. For example, an initial sorting step has been done by a collection point for tires, e.g. car tires and truck tires. The car tires are further subjected to a sorting step, especially according to the present method for sorting tires on basis of its silica content. Please note that the location of the collection point for tires can be different from the location where the present method is to be carried out.

According to a continuous mode of the present method for sorting tires on basis of its silica content the tires to be sorted are placed on a conveyor, wherein the thus placed tires are transported by the conveyor to at least one station for measuring the silica content of the tires, wherein the station further comprises means for analyzing the data provided by the measuring method and means for providing a signal for separating the tires thus measured into the low silica content stream and the high silica content stream.

In an embodiment of the present method the high silica content stream is destructed in a destruction process into at least a tread comprising high silica content stream and a non-tread comprising high silica content stream, especially the silica percentage in said tread comprising high silica content stream is in a range of 20-50 wt. %, preferably 30-40 wt. %, on basis of the total weight of said tread comprising high silica content stream. In addition, the silica percentage in said non-tread high silica content stream is preferably in a range of lower than 5 wt. %, more preferably lower than 2 wt. %, on basis of the total weight of said non-tread comprising high silica content stream.

In another embodiment the low silica content stream is destructed in a destruction process into at least a tread comprising low silica content stream and a non-tread comprising low silica content stream, especially that the silica percentage in said tread comprising low silica content stream is in a range of lower than 5 wt. %, preferably lower than 2 wt. %, on basis of the total weight of said tread comprising low silica content stream. In addition, the silica percentage in said non-tread low silica content stream is preferably in a range lower than 5 wt. %, more preferably lower than 2 wt. %, on basis of the total weight of said non-tread comprising low silica content stream.

According to these embodiments the tires, especially passenger car tires, are sorted into silica tires, i.e. a high silica content stream, and into non-silica tires, i.e. a low silica content stream.

The so-called silica tires are destructed into at least a tread comprising stream and a non-tread comprising stream. The present inventors found that in such a tread comprising stream the silica content is typically in a range of 33-38 wt. %. The carbon black content in such a tread comprising stream is typically in a range of 5-10 wt. %, where carbon blacks are relatively small average primary particle size (for example an average primary particle size in a range of 18-23 nanometer), e.g. N100, N200, N300 series, ASTM "N" standards, ASTM 1765-14. The silica content in such a non-tread comprising stream is typically <2 wt. %. The carbon black content in such a non-tread comprising stream is typically 25-30 wt. %, where carbon blacks are relatively large average primary particle size (for example an average primary particle size in a range of 58-63 nanometer), e.g. N500, N600, N700 series, ASTM "N" standards, ASTM 1765-14.

The so-called non-silica tires are destructed into at least a tread comprising stream and a non-tread comprising stream. The present inventors found that in such a tread comprising stream the silica content is typically <1 wt. %. The carbon black content in such a tread comprising stream is typically in a range of 25-30 wt. %, where carbon blacks are relatively small average primary particle size (for example an average primary particle size in a range of 18-23 nanometer), e.g. N100, N200, N300 series, ASTM "N" standards, ASTM 1765-14. The present inventors found that in such a non-tread comprising stream the silica content is typically <2 wt. %. The carbon black content in such a non-tread comprising stream is typically in a range of 25-30 wt. %, where carbon blacks are relatively large average primary particle size (for example an average primary particle size in a range of 58-63 nanometer), e.g. N500, N600, N700 series, ASTM "N" standards, ASTM 1765-14.

The sole FIGURE shows the above discussed process in a block diagram. Passenger car tires 15 are separated into silica tires 1 and non-silica tires 2. Silica tires 1 are separated into tread 3 and non-tread 4. Tread 3 is composed of high silica content 7 and low carbon black content (and having a relatively small average primary particle size) 8. Non-tread 4 is composed of low silica content 9 and high carbon black content (and having a relatively large average primary particle size) 10. Non-silica tires 2 are separated into tread 5 and non-tread 6. Tread 5 is composed of low silica content 11 and high carbon black content (and having a relatively small average primary particle size) 12. Non-tread 6 is composed of low silica content 13 and high carbon black content (and having a relatively large average primary particle size) 14.

Separating these tire components will deliver more differentiated products compared to only differentiating according to silica content. The tread: non-tread separation process may require two steps: separate the tread and inner liner from the rest of the tire, for example by using a machine like a TRS T-CUT (trademark, Tire Recycling Solutions SA, for example the apparatus as disclosed in WO2015/162443), separate the tread from the inner liner, for example by using a water-jet cutter.

The present invention furthermore relates to an apparatus for carrying out the method as discussed above, wherein the present apparatus comprises means for conveying unsorted tires to a downstream located measuring station, the measuring station comprising means for measuring the silica content of the tires, the measuring station further comprising means for analyzing the data provided by the measuring means and means for providing a signal for separating the tires thus measured into the low silica content stream and the high silica content stream. A computer system including software and algorithms can be used for processing the data generated by the means for measuring the silica content of the tires. A calibration curve can be mentioned here as a suitable algorithm to convert the data generated by the means for measuring the silica content of the tires into a value of the silica content.

The means for measuring the silica content of the tires comprise one or more sensor-based technologies chosen from the group of electrical resistivity (ER), X-ray fluorescence (XRF), Near-infrared (NIR) and laser-induced plasma spectroscopy (LIPS), wherein it is preferred to apply a measuring method according to X-ray fluorescence (XRF). In another embodiment the apparatus further comprises means for drying the unsorted tires, said means for drying the unsorted tires being positioned upstream from the measuring station comprising means for measuring the silica content of said tires. As an example of such means for drying tires a station provided with hoses for delivering pressurized air can be mentioned. The air to be supplied can be preheated.

The present invention furthermore relates to the use of scrap rubber in a pyrolysis process to obtain a char material, wherein the scrap rubber is a low silica content stream consisting of tires in which 95% of the tires has a silica percentage lower than 15 wt. % obtained according to the sorting method as discussed above.

According to another embodiment It is preferred to use scrap rubber in a pyrolysis process to obtain a char material, wherein the scrap rubber is a high silica content stream consisting of tires in which 95% of the tires has a silica percentage higher than 15 wt. % obtained according to the sorting method as discussed above. Such a pyrolysis process preferably comprises at least a two-stage pyrolysis process, wherein the two-stage pyrolysis process comprises: a) a first pyrolysis stage to obtain an intermediate char material and b) a second pyrolysis stage to obtain the char material and wherein at least one of the stages a) or b) is carried out in a rotary kiln. A preferred method for such a two-stage pyrolysis process, including its process conditions, has been disclosed in the already discussed WO 2013/095145 in the name of the present inventors.

The term "silica" as used herein refers silica or amorphous silica, silica gel. For example silica is produced by the acidification of solutions of sodium silicate. The gelatinous precipitate is first washed and then dehydrated to produce colorless microporous silica. This term also includes silica obtained from sand.

The invention will be explained hereinafter by means of a number of examples in which connection it should be noted, however, that the present invention is by no means limited to such examples.

EXAMPLES

The measurements were done with the industrial on-line XRF analyzer CON-X03M. XRF analyzer with so called close geometry of measuring unit was used. This means that the X-ray tube and the detector are configured so that the focal spot which is excited by primary X-ray radiation on the surface of the analyzed material (and which is seen by the detector) is placed at a distance of <5 mm from the measuring cell.

The instrument has one channel (measurement point) and easily variable sample excitation conditions. Measurement conditions are specified in Table 1.

TABLE 1

| Measurement conditions | |
|---|---|
| Analyzer | CON-X 03M |
| X-ray tube anode material | Ag |
| Primary radiation filter | No filter |
| X-ray tube voltage | 8.0 kV |
| X-ray tube current | 800 μA |
| Measurement time | 10 and 300 s |
| Ambient medium | Ambient temperature/vacuum 0.15 Torr |
| Distance between the sample and analyzer | ~2 mm |
| XRF detector | Si, SDD type |

Measurement of Tire Tread Surface

Spectra of the LS (Low silica, <10%, m/m) and HS (high silica, >10%. m/m) samples measured from the tread sides are shown in FIG. 1. For comparison FIG. 1 also shows the spectrum of a black rubber cord used for the production of conveyor belts. The material for the conveyor belt is produced by converting the corresponding polymers into a more durable rubber material via the process of vulcanization with sulfur. The intensity of Si XRF line measured for HS sample on the tread side is substantially higher than for LS sample. In contrast, Si line is much weaker for the conveyor belt rubber which is vulcanized with sulfur. It is noteworthy that the intensity of Si XRF line is in the inverse proportion to the intensity of Si line for the samples under study. The difference between Si line intensities measured for HS and LS tread surfaces is significant. The essential difference between the intensities of target spectral line for the two types of silica tires is crucial for reliable and accurate pre-sorting and separation them on the conveyor in real time.

Measurement of the Side Surface of Tires.

Sub-samples of the side parts of the tire were also prepared and measured. Typical spectrum of the side surface of HS tire is shown in FIG. 2 as an example.

For comparison on the same FIGURE another line shows the spectrum measured on the tread sub-sample of HS tire. Therefore the difference between silica content in different parts of the tire is clearly demonstrated by the intensity of Si spectral line (FIG. 2). Si line intensity that is measured on the side surface of HS tire is much weaker compared to HS tread sample. The former is close to the intensity obtained for the tread surface of LS tire. Therefore the intensities of the Si spectral line measured for tread and side surfaces of the tire are not equal. This difference is observed both for HS and LS grades: Si line measured on the tread surface is higher in the both cases. The difference between Si line intensities of tread and side surfaces is more significant for HS tire.

On basis of this measurement it is preferred that the tires must be somehow directed in a proper position on the transporting mechanism, such as a conveyor, so that the measuring unit could "see" the tread surface but not side surface of the tire. Thus it is preferred to apply a mechanism that could direct each tire in the vertical position before the measurement is carried out.

Additional measurements have shown that a layer of water or just a humid surface of material being measured can affect readings (Si XRF line intensity) thus affecting the separation. Therefore it is preferred that the more dry the surface the tread of the tire is, the higher is the Si line intensity and the more accurate and reliable is the step of sorting. The inventors assume that the presence of water decreases the Si line intensity due to partial absorption of silicon XRF photons in water and attenuation of their energy.

On basis of the above one may conclude that the intensity of Si XRF line measured for HS sample on the tread side is substantially higher than for LS sample. The essential difference between the intensities of silicon line for two types of silica tires is crucial for reliable and accurate pre-sorting and separation them on the conveyor in real time. In addition, Si line intensity measured on the tread surface of the tire is higher than on side surface both for LS and for HS grades. The difference between Si line intensities of tread and side surfaces is much more significant for HS tire. Furthermore, a water layer on the surface of the material to be measured affects readings (Si XRF spectral line intensity) in some extent. In a situation of a short time of measurement, namely in a range of about 10 seconds, it is thus preferred to measure on a dry tread surface.

The invention claimed is:

1. A method for sorting tires on basis of silica content, comprising:

sorting said tires into a low silica content stream or a high silica content stream on basis of the silica content of said tires, wherein said low silica content stream consists of tires in which 90% of the tires has a silica percentage lower than 15 wt. % and wherein said high silica content stream consists of tires in which 90% of the tires has a silica percentage higher than 15 wt. %, wherein the weight percentage is based on the total weight of the tire.

2. The method of claim 1, wherein said silica content of said tires is measured by using one or more sensor-based technologies chosen from the group of electrical resistivity (ER), X-ray fluorescence (XRF), Near-infrared (NIR) and laser-induced plasma spectroscopy (LIPS).

3. The method of claim 2, wherein said silica content of said tires is measured by using X-ray fluorescence (XRF).

4. The method of claim 1, wherein non-destructed tires are sorted.

5. The method of claim 2, wherein said measurement is carried out on a tire tread surface of said tires.

6. The method of claim 1, wherein the tires to be sorted are placed on a conveyor, wherein the thus placed tires are transported by said conveyor to at least one station for measuring the silica content of said tires, wherein said station further comprises means for analyzing the data provided by said measuring method and means for providing a signal for separating the tires thus measured into said low silica content stream and said high silica content stream.

7. The method of claim 1, wherein the surface of the tires on which the measurement is to be carried out is dry.

8. The method of claim 1, wherein said high silica content stream is destructed in a destruction process into at least a tread comprising high silica content stream and a non-tread comprising high silica content stream, characterized in that the silica percentage in said tread comprising high silica content stream is in a range of 20-50 wt. %, on the basis of the total weight of said tread comprising high silica content stream, characterized in that the silica percentage in said non-tread high silica content stream is in a range of lower than 5 wt. % on the basis of the total weight of said non-tread comprising high silica content stream.

9. The method of claim 1, wherein said low silica content stream is destructed in a destruction process into at least a tread comprising low silica content stream and a non-tread comprising low silica content stream.

10. The method of claim 9, wherein the silica percentage in said tread comprising low silica content stream is in a range of lower than 5 wt. %, on the basis of the total weight of said tread comprising low silica content stream.

11. The method of claim 10, wherein the silica percentage in said non-tread low silica content stream is in a range lower than 5 wt. % on the basis of the total weight of said non-tread comprising low silica content stream.

12. The method of claim 1, wherein, said low silica content stream consists of tires in which 95% of the tires has a silica percentage lower than 15 wt. % and wherein said high silica content stream consists of tires in which 95% of the tires has a silica percentage higher than 15 wt. %, wherein the weight percentage is based on the total weight of the tire.

13. An apparatus for carrying out the method according to claim 1, said apparatus comprising means for conveying unsorted tires to a downstream located measuring station, said measuring station comprising means for measuring the silica content of said tires, said measuring station further comprising means for analyzing the data provided by said measuring means and means for providing a signal for separating the tires thus measured into said low silica content stream and said high silica content stream wherein said low silica content stream consists of tires in which 90% of the tires has a silica percentage lower than 15 wt. % and wherein said high silica content stream consists of tires in which 90% of the tires has a silica percentage higher than 15 wt. %, wherein the weight percentage is based on the total weight of the tire.

14. The apparatus of claim 13, wherein said means for measuring the silica content of said tires comprise one or more sensor-based technologies chosen from the group of electrical resistivity (ER), X-ray fluorescence (XRF), Near-infrared (NIR) and laser-induced plasma spectroscopy (LIPS).

15. The apparatus of claim 14, wherein said means for measuring the silica content of said tires comprise X-ray fluorescence (XRF).

16. The apparatus of claim 15, wherein said apparatus comprises means for positioning the tires to be sorted such that said means for measuring the silica content of said tires carry out said measurement on the tire tread surface of said tires.

17. The apparatus of claim 16, wherein said apparatus further comprises means for drying the unsorted tires, said means for drying the unsorted tires being positioned upstream from the measuring station comprising means for measuring the silica content of said tires.

18. The apparatus of claim 17, wherein said apparatus further comprises means for destructing said low silica content stream into a tread comprising low silica content stream and a non-tread comprising low silica content stream.

19. The apparatus of claim 17, wherein said apparatus further comprises means for destructing said high silica content stream into a tread comprising high silica content stream and a non-tread comprising high silica content stream.

20. A method of performing a pyrolysis process to obtain a char material, comprising:

using scrap rubber from a high silica content stream consisting of tires in which 95% of the tires has a silica percentage higher than 15 wt. % obtained according to a method according to claim 1, wherein said tires mainly comprise tread parts of tires, in a pyrolysis process, wherein said pyrolysis process pyrolysis comprises at least a two-stage pyrolysis process, wherein the said two-stage pyrolysis process comprises: a) a first pyrolysis stage to obtain an intermediate char material and b) a second pyrolysis stage to obtain said char material and wherein at least one of the stages a) or b) is carried out in a rotary kiln, wherein said scrap rubber is fed into said first pyrolysis stage.

* * * * *